US008798782B2

(12) United States Patent
Lancaster-Larocque et al.

(10) Patent No.: US 8,798,782 B2
(45) Date of Patent: Aug. 5, 2014

(54) MATERIAL REMOVAL DEPTH MEASUREMENT BY SCRIBING

(75) Inventors: Simon R. Lancaster-Larocque, Gloucester (CA); Lucas Allen Whipple, Belmont, CA (US)

(73) Assignee: Apple Inc., Cupertino, CA (US)

( * ) Notice: Subject to any disclaimer, the term of this patent is extended or adjusted under 35 U.S.C. 154(b) by 104 days.

(21) Appl. No.: 13/531,562

(22) Filed: Jun. 24, 2012

(65) Prior Publication Data

US 2013/0084780 A1 Apr. 4, 2013

Related U.S. Application Data

(60) Provisional application No. 61/542,032, filed on Sep. 30, 2011.

(51) Int. Cl.

| | |
|---|---|
| ***G06F 19/00*** | (2011.01) |
| ***B24B 49/00*** | (2012.01) |
| ***B24B 51/00*** | (2006.01) |
| ***B24B 1/00*** | (2006.01) |
| ***F27D 11/00*** | (2006.01) |

(52) U.S. Cl.
USPC ..... 700/170; 451/5; 451/54

(58) Field of Classification Search
CPC ..... B23Q 1/34; B24B 49/16; B24B 37/013; B24B 1/00; B24B 37/345; B24B 37/3455
USPC ..... 700/170; 451/5, 54; 219/385
See application file for complete search history.

(56) References Cited

U.S. PATENT DOCUMENTS

| | | | | |
|---|---|---|---|---|
| 5,077,941 | A * | 1/1992 | Whitney | 451/5 |
| 6,408,578 | B1 * | 6/2002 | Tanaka et al. | 52/204.62 |
| 7,507,145 | B1 * | 3/2009 | Zurbuchen | 451/6 |
| 8,173,450 | B1 * | 5/2012 | Tian et al. | 438/14 |
| 2003/0074771 | A1 * | 4/2003 | Duffy | 24/442 |
| 2010/0275794 | A1 | 11/2010 | Silchenstedt et al. | |
| 2011/0081839 | A1 | 4/2011 | Lancaster et al. | |

FOREIGN PATENT DOCUMENTS

| | | |
|---|---|---|
| JP | 2000-286173 A | 10/2000 |
| JP | 2004-536716 A | 12/2004 |
| JP | 2011-012963 A | 1/2011 |

OTHER PUBLICATIONS

International Search Report and Written Opinion for International Patent Application No. PCT/US2012/057079, dated Feb. 25, 2013.

* cited by examiner

*Primary Examiner* — Mohammad Ali
*Assistant Examiner* — Ziaul Karim
(74) *Attorney, Agent, or Firm* — Womble Carlyle Sandridge & Rice LLP

(57) ABSTRACT

The described embodiment relates generally to the polishing of a device housing. The device housing can be formed of a thermoplastic, or a metal such as aluminum or stainless steel. More particularly, a method and an apparatus are described for accurately measuring the amount of material removed during a polishing process. Accurate measurement of such a polishing process can be especially helpful in measuring material removal on curved surfaces and edges where material removal rates tend to be less predictable.

19 Claims, 12 Drawing Sheets

MATERIAL REMOVAL DEPTH MEASUREMENT BY SCRIBING

CROSS-REFERENCE TO RELATED APPLICATION

This application claims priority to and the benefit under 35 U.S.C. 119(e) of U.S. Provisional Patent Application Ser. No. 61/542,032 filed Sep. 30, 2011, entitled SCRIBING FOR POLISHING PROCESS VALIDATION, the entire disclosure of which is hereby incorporated by reference.

TECHNICAL FIELD

The described embodiment relates generally to refining polishing operations for cosmetic surfaces of a three dimensional object having cosmetic curved surfaces. More particularly, a method and an apparatus are described for accurately removing material from a curved, cosmetic surface of a housing during a polishing operation.

BACKGROUND OF THE INVENTION

The proliferation of high volume manufactured, portable electronic devices has encouraged innovation in both functional and aesthetic design practices for enclosures that encase such devices. Manufactured devices can include a casing that provides an ergonomic shape and aesthetically pleasing visual appearance desirable to the user of the device. Surfaces of casings molded from thermoplastic compounds can be shaped and polished to a highly reflective finish; however, the polished reflective surface can reveal minor variations in the final surface geometry. Molded casings can include complex geometric shapes that are difficult to finish to a uniform surface appearance. Prior art techniques can result in a tactilely smooth finish with an undesirable variation in visual reflective appearance. Moreover, due to the soft nature of polishing media, it is difficult to provide a consistent polishing process over a surface of the housing resulting in visually obvious variations in the surface finish.

Thus there exists a need for a method and an apparatus for polishing a three dimensional curved edge of an object resulting in a visually smooth and consistent reflective appearance.

SUMMARY

This paper describes many embodiments that relate to an apparatus, method and computer readable medium for enabling precise material removal as part of a polishing process.

In a first embodiment a method is disclosed for refining polishing accuracy across a curved surface of a housing. The method includes at least the following steps: (1) providing a number of clustered scribe marks across at least a portion of the curved surface of the housing; (2) polishing the surface of the housing including the clustered scribe marks; and (3) optically checking a material removal amount around the plurality of clustered scribe marks by observing which of the plurality of indicia have been polished away during the polishing step. The clustered scribe marks include at least a number of indicia, each indicia having a different depth dimension, the deepest of the indicia having a depth no greater than a maximum material removal depth. The relative position of each indicia in relation to other indicia in that clustered scribe mark makes it optically discernible from the other indicia.

In another embodiment an apparatus for scribing optically readable scribe marks into a curved surface of a housing is disclosed. The apparatus includes at least the following: (1) a laser having a wavelength small enough to etch scribe marks narrower than a minimum abrasive particle diameter of a polishing pad subsequently used to polish the housing; (2) a computer numerical control (CNC) system for orienting the laser along a desired scribe mark path as it cuts scribe marks across the curved surface of the housing; and (3) a housing support fixture able to maintain the housing at a desired orientation during a laser scribing operation. In this embodiment the laser scribes optically readable scribe marks by scribing a plurality of clustered scribe marks into the curved surface of the housing. The clustered scribe marks include a number of indicia, each indicia having a different depth dimension, the deepest of the indicia having a depth no greater than a maximum material removal depth. The relative position of each indicia in relation to other indicia in that clustered scribe mark makes it optically discernible from the other indicia.

In yet another embodiment a non-transient computer readable medium for storing computer code executable by a processor in a computer aided manufacturing system for accurately polishing across a curved surface of a housing is disclosed. The non-transient computer readable medium includes at least the following: (1) computer code for providing a clustered scribe marks across the surface of the housing; (2) computer code for polishing the surface of the housing including the plurality of clustered scribe marks; and (3) computer code for optically checking a material removal amount around the plurality of clustered scribe marks by observing which of the plurality of indicia have been polished away during the polishing step. The clustered scribe marks include at least a number of indicia, each indicia having a different depth dimension, the deepest of the indicia having a depth no greater than a maximum material removal depth. The relative position of each indicia in relation to other indicia in that clustered scribe mark makes it optically discernible from the other indicia;

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Figure 1A:
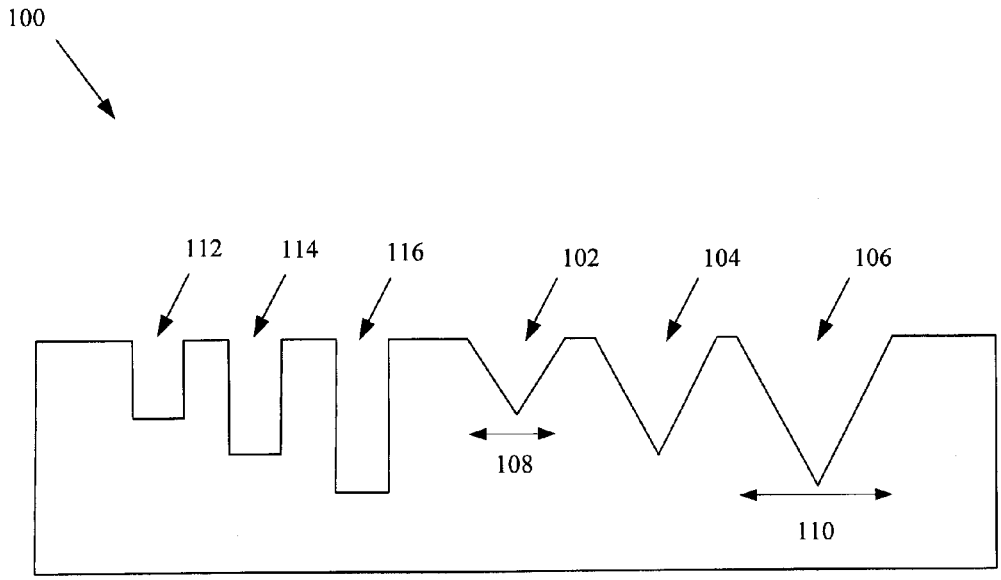
FIG. 1A illustrates a cross-sectional view of a workpiece having a number of scribe marks having different depths and shapes.

The described embodiments relate generally to the polishing of a three dimensional curved surface of an object. More particularly, a method and an apparatus are described for polishing the surface of the object, formed using either an injection molded thermoplastic compound, or a metal such as aluminum or stainless steel. In some embodiments the object can have a visually smooth and consistent reflective appearance.

In the following description, numerous specific details are set forth to provide a thorough understanding of the present invention. It will be apparent, however, to one skilled in the art that the present invention may be practiced without some or all of these specific details. In other instances, well known process steps have not been described in detail in order to avoid unnecessarily obscuring the present invention.

Manufacturing processes for producing consumer electronic devices often involve a polishing step to imbue the device with a pleasing overall look and feel. These polishing steps can be applied to numerous types of materials such as for example, aluminum, stainless steel, and injection molded thermoplastics with various geometrically shaped surfaces. Unfortunately, polishing pads and especially soft polishing pads are notoriously difficult to control, particularly when they are applied to curved surfaces. Poorly controlled polishing operations can result in large sample variations causing high rates of component rejection. These types of variations can cause even higher rejection rates when components have a mirror-like or highly reflective surface as even small surface variations can be noticeable. This controllability difficulty makes the determination of the amount of polishing to conduct during a polishing step problematic at best. One way to refine polishing operations and achieve removal of a precise amount of material is to engrave scribe marks into the surface of the material to be polished. The scribe marks can be engraved in a number of ways including mechanical scribing and laser scribing. The scribing can be applied in the following scenarios: (1) establishing a maximum material removal depth for specific processing vendors; (2) determining whether a defect can be removed without noticeably changing the surface contour of a device; (3) rendering a variable depth, human readable set of scribe marks into a surface; and (4) establishing and periodically recalibrating a polishing baseline.

Accidents can happen in any manufacturing line, and when those accidents cause damage to components having cosmetic surfaces even the smallest ding or scratch can be problematic. In many cases manufacturers will attempt to buff or polish out such a scratch or ding from a cosmetic surface. When a polishing process removes too much material a number of undesirable conditions can occur. First, as stated above surface variations can become visible if the contour of the surface is changed too rapidly. Second, in some cases components may not lie flat if too much material is removed.

In one of its embodiments the described embodiment can overcome these problems. For example, the unibody MacBook Pro® manufactured by Apple Inc. of Cupertino, Calif. is machined from a single block of aluminum. By placing scribe marks at regular positions along the surface of an aluminum block at the beginning of the manufacturing process that extend to a depth just above the permissible limit for material removal it becomes quite clear when one of the aluminum blocks has had too much material removed from it. In this case a final finishing step in the manufacturing line can be to polish away the regularly positioned scribe marks. Without such scribe marks many manufacturers have been able to mask defects that did not show up until much later in the production line, at which point it becomes more costly to reject the component. By being able to reference the scribe marks a component manufacturer can understand exactly how much material can be removed to fix any potential scratches or dings that may occur during the manufacturing process. Furthermore, quality checking becomes more efficient. In one embodiment a vision system can be set up to automatically check scribe marks of components coming off the line, making quality assurance quick and accurate. In some embodiments if a scribe mark is completely gone too much material was removed, while a scribe mark that is deeper than an expected depth threshold can indicate a situation where not enough material was removed.

Sometimes during for example a refurbishing operation nicks and scratches must be removed to return the product to acceptable condition. Since nicks and scratches are commonly found on protruding edges the amount of material removed by a certain amount of polishing operations will be highly dependent on location and geometry of the defect. In the event of an occurrence like this scribe marks can be embedded around the defect, accurately dictating the maximum permissible material depth removal in each of the surrounding regions. If the defect can be removed without completely removing any of the surrounding scribe marks then the component can be salvaged and used again. In some instances the use of scribe marks to accurately dictate permissible material removal can allow a defect to be successfully removed that might not otherwise be fixable; this is because over polishing of the damaged portion of the component can result in irreparable damage to that part.

In another embodiment complex shapes can be etched into the surface of a part. While the described embodiment encompasses a variety of techniques for creating such shapes, one technique well suited for use with the described embodiment is laser scribing. By utilizing laser scribing techniques complex shapes can be etched into the surface of a part. By varying the shape and arrangement of the complex shapes, the complex shapes can become human readable in some embodiments. These complex shapes can also be etched at a variety of depths. For example, a laser can be used that etches away a known amount of material. By making multiple passes with that laser the depth of the scribe mark can be precisely modulated to obtain scribe marks having different depths with a single laser. By clustering a number of recognizable shapes in relative positions, each character etched at its own depth a human or machine can visually determine how much material has been removed from that area by how many of the characters have been removed during the polishing process. In this way a multi-step polishing process can be accomplished where the clustered shapes each represent an appropriate material removal depth for one step in the multi-step material removal process.

In yet another embodiment a scribing process can be used to calibrate a polishing process in a set of destructive tests. As previously discussed, material removal rates for polishing pads can be hard to predict, and particularly difficult around curved surfaces or corners. However, once a process is established more predictability can be achieved. One way to establish such a process is to etch scribe marks in a workpiece at depths deeper than the targeted surface depth. In addition to accurate measurement of material removal amount scribe marks can be used to establish a datum along an otherwise curved surface. Once a datum is established at a known position on the part undergoing destructive testing, the positioning of the polishing pads becomes much easier and repeatable from test to test. Once the polishing pads are properly oriented to the part by way of the scribe based datum a polishing process can be conducted in which the number of polishing pad passes are measured. Periodic measurements of the remaining scribe depth can be made after a certain number of passes have been made. In this way a manufacturer can gain a reasonable amount of certainty over the amount of passes must be made to produce a finished component. Since the scribe depths are made deeper than the cosmetic surface of the part the workpiece is scrapped at the end of the measurements. It should be noted that grain size of the course elements on the polishing pads should be of greater diameter than the width of the scribe mark. This prevents dislodged abrasive particles from increasing the depth of the scribe marks when they become trapped in a bottom portion of a particular scribe mark A number of these destructive tests can be conducted before a refined process is achieved. Since polishing pads can wear out quickly even after the process has been refined as part of the initial process development, a manufacturer may need to run destructive tests periodically, sometimes referred to as process drift measurements in order to ensure the installed set of pads are performing predictably. Depending on the component tolerances and polishing pad durability this can be something that would need to be accomplished with more or less frequency. Such subsequent destructive testing would essentially amount to a calibration test to ensure the pads are operating correctly. This type of testing could be used in conjunction with or independently of a process including scribe marks on the actual production components.

These and other embodiments are discussed below with reference to FIGS. 1-12; however, those skilled in the art will readily appreciate that the detailed description given herein with respect to these figures is for explanatory purposes only and should not be construed as limiting.

FIG. 1A shows a cross sectional views workpiece 100 having a number of different scribe marks engraved into it. The geometry of the scribe marks is largely related to the method of engraving the marks into a workpiece. Scribe marks 102, 104, and 106 are mechanically engraved into workpiece 100. Scribe marks 102, 104, and 106 can be mechanically inscribed with a diamond tipped cutting tool. The shape of the scribe mark will generally match the shape of the mechanical tool used to cut it. In this case the diamond tipped cutting tool causes a triangularly shaped scribe mark channel to be formed. The deeper the scribe mark the wider the opening is to the scribe mark when using a mechanical cutting tool having the same pitch to scribe various depths as shown. For example opening 108 of scribe mark 102 is significantly smaller than opening 110 of deeper scribe mark 106. Larger openings may be undesirable in situations where as will be discussed later an abrasive particle size of the polishing pad can fit within the opening of the scribe mark.

Figure 1B:
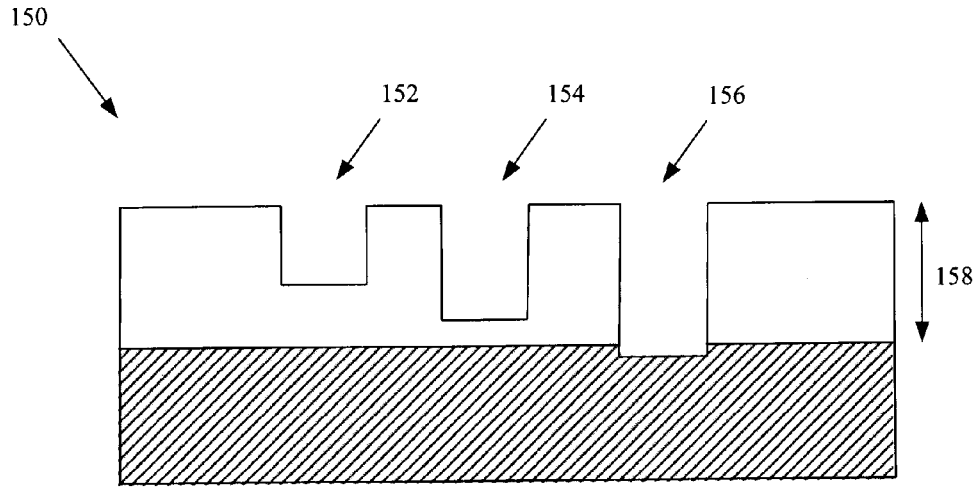
FIG. 1B illustrates a cross-sectional view of a workpiece having a number of scribe marks, one of which extends past a maximum material removal depth.

Scribe marks 112, 114, and 116 are scribe marks created by laser scribing. Laser scribe marks suitable for high accuracy work are generally high energy laser beams with low wavelengths. A relatively lower wavelength allows the laser to work with increased cutting accuracy. One advantage of laser scribing is the depth of such scribe marks can be made extremely accurately. Scribe mark 112, 114, and 116 for example can be etched to depths having very little variation. Since scribe depths can have a depth of only 50 microns (or 0.05 millimeters) there is little room for error. In one embodiment scribe mark 112 can have a depth of 10 microns, scribe mark 114 can have a depth of 30 microns, and scribe mark 116 can have a depth of 50 microns. In a configuration as shown where the scribe marks are arranged closely together it becomes easy to tell exactly how much material is missing. If for example, scribe marks 112 and 114 have been polished away it would be clear that between 30 and 50 microns of material have been removed. In some embodiments where destructive testing is used only a single scribe mark can be needed. By engraving a scribe mark at a depth below the material removal depth the amount of removed material can always be accurately determined by measuring the depth of the scribe mark. FIG. 1B illustrates a set of clustered scribe marks 152, 154, and 156 extending below a maximum material removal depth 158 of workpiece 150. A destructive test can be run in which the disappearance of scribe marks 152 and 154 optically indicate how quickly material is being removed from the surface of workpiece 150, and scribe mark 156 allows a precise material removal amount to be determined even once workpiece 150 has been polished down to its maximum material removal depth 158. Such a determination can be taken by a variety of measurement tools such as a laser interferometer or microscope.

Figure 2A:
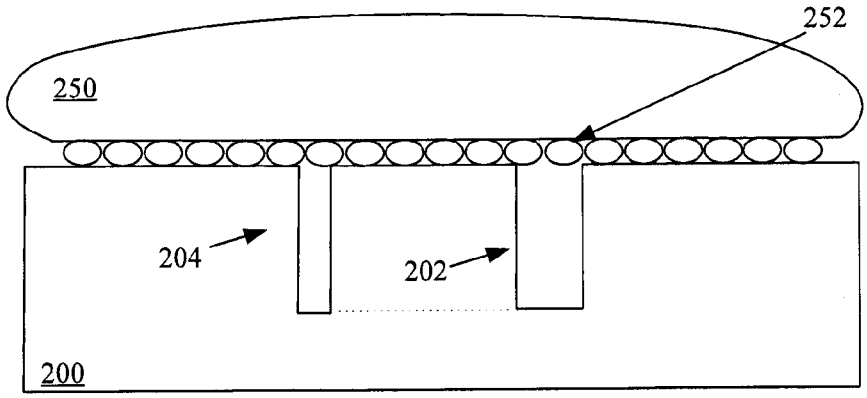
FIG. 2A illustrates a polishing pad conducting a polishing operation over two scribe marks with different sized openings.
Figure 2B:
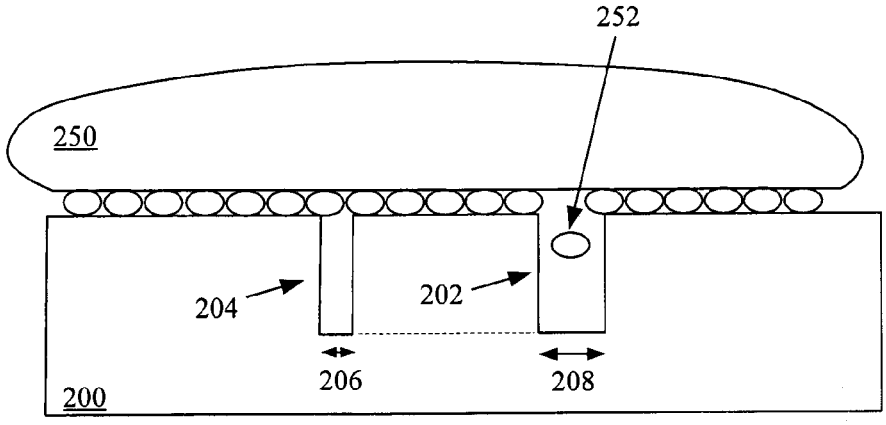
FIG. 2B illustrates how a polishing pad can have abrasive particles dislodge during a polishing operation and drop into a scribe mark with a sufficiently large opening.
Figure 2C:
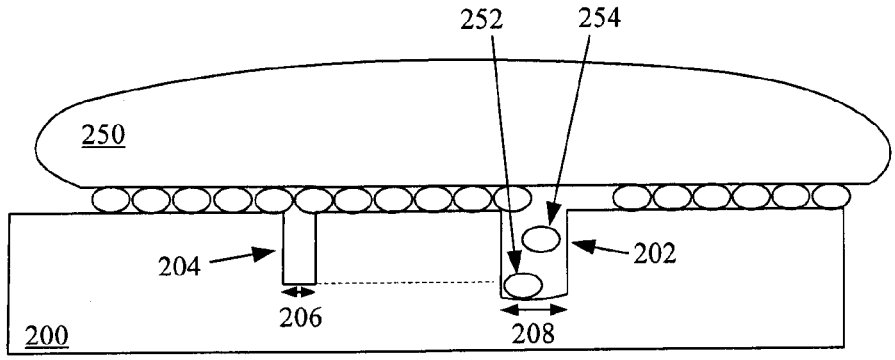
FIG. 2C illustrates how dislodged abrasive particles lying in a scribe mark can increase a depth dimension of that scribe mark.

FIGS. 2A-2C illustrate a cross sectional view of a workpiece 200 with scribe marks 202 and 204 being polished by polishing pad 250. While polishing pads may have very fine textures for creating a smooth surface they still contain abrasive particles for material removal. It should be noted that the described embodiment applies equally to other abrasive tools in addition to polishing pads, such as for example buffing wheels. For the sake of simplicity a polishing pad will be used for exemplary purposes. FIG. 2A shows polishing pad 250 performing a polishing operation on a surface portion of workpiece 200. Polishing pad 250 can have abrasive particles including abrasive particle 252 arranged on its polishing surface. As polishing pad 250 polishes and removes material from the surface of workpiece 200 FIG. 2B shows how abrasive particle 252 can become dislodged from polishing pad 250 and become lodged in scribe mark 202. Because scribe mark 206 is narrower than or equal to the diameter of the abrasive particles found on polishing pad 250 dislodged abrasive particles do not become lodged in scribe mark 204. In FIG. 2C an additional abrasive particle 254 has become dislodged from polishing pad 250 and settled into scribe mark 208. Scribe mark 202 is now substantially deeper than scribe mark 204. This is a result of abrasive particle 252 and 254 interacting with a bottom channel portion of scribe mark 202. This interaction can be the result of vibration of the workpiece during polishing or even motion of dust particles from the polishing which may also be filling scribe mark 202 and causing abrasive particles to be drawn along the bottom channel portion of scribe mark 202. Since scribe mark 202 has been made deeper than it was originally etched a manufacturing process can be compromised as scribe mark 202 now gives a false indication of how much material has actually been removed from workpiece 200. Consequently, scribe marks 202 should be etched narrower than the diameter of abrasive particles present on polishing pad 250 to prevent the problems illustrated in this figure.

Figure 3:
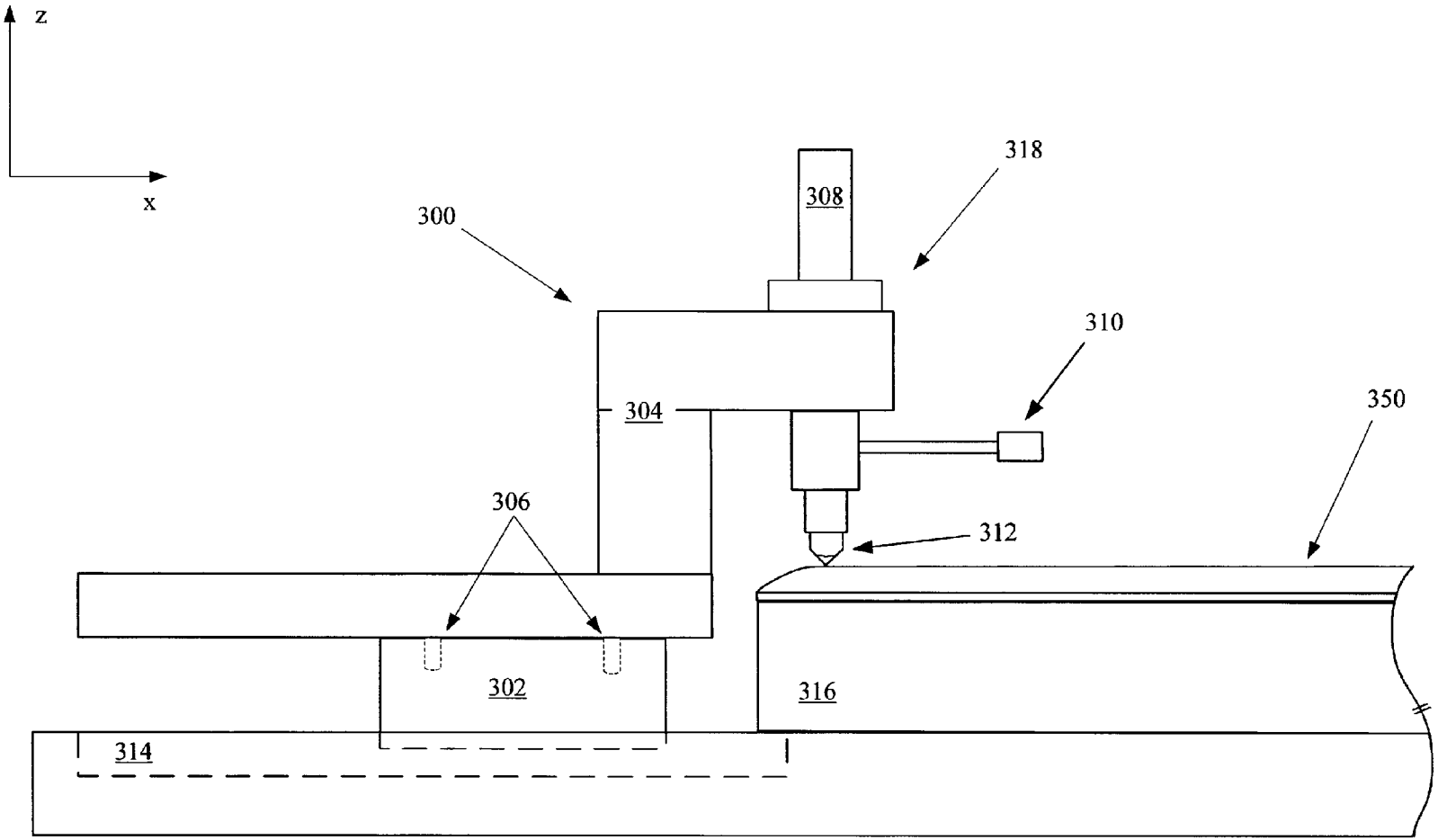
FIG. 3 illustrates a mechanical scribing fixture in accordance with the described embodiment.

FIG. 3 illustrates a partial cross-sectional view of mechanical scribing fixture 300 scribing workpiece 350. Scribing fixture 300 is mounted on mounting block 302. Mounting block 302 allows scribing fixture support arm 304 to be mechanically coupled to mounting block 302 by four attachment posts 306 protruding from the bottom surface of scribing fixture support arm 304. In one embodiment scribing fixture support arm can be made of three blocks of stainless steel mechanically coupled together. Scribing fixture support arm 304 provides support to scribing assembly 318. Scribing assembly 318 includes pressure adjustment knob 308, scribing tool release lever 310, and diamond tipped scribe 312. In one embodiment pressure adjustment knob 308 can be configured to adjust the tension on a spring which sets the pressure at which diamond tipped scribe 312 comes into contact with workpiece 350. Scribing tool release lever 310 is useful for raising diamond tipped scribe 312 above the surface of workpiece 350 after a scribe mark has been mechanically etched into workpiece 350. Channel 314 is designed to allow attachment feature 302 to slide closer and farther away from workpiece support fixture 316. Since mounting block 302 is mechanically coupled to scribing fixture 300, when mounting block 302 is moved away from workpiece 350 along channel 314, then if diamond tipped scribe 312 is in contact with workpiece 350 (as illustrated) then diamond tipped scribe 312 can etch a scribe mark into workpiece 350 as it is dragged across workpiece 350. After diamond tipped scribe 312 is dragged to the end of workpiece 350, scribing tool release lever 310 can be used to lift diamond tipped scribe 312 back up until it is used again to etch another mark in workpiece 350.

Figure 4:
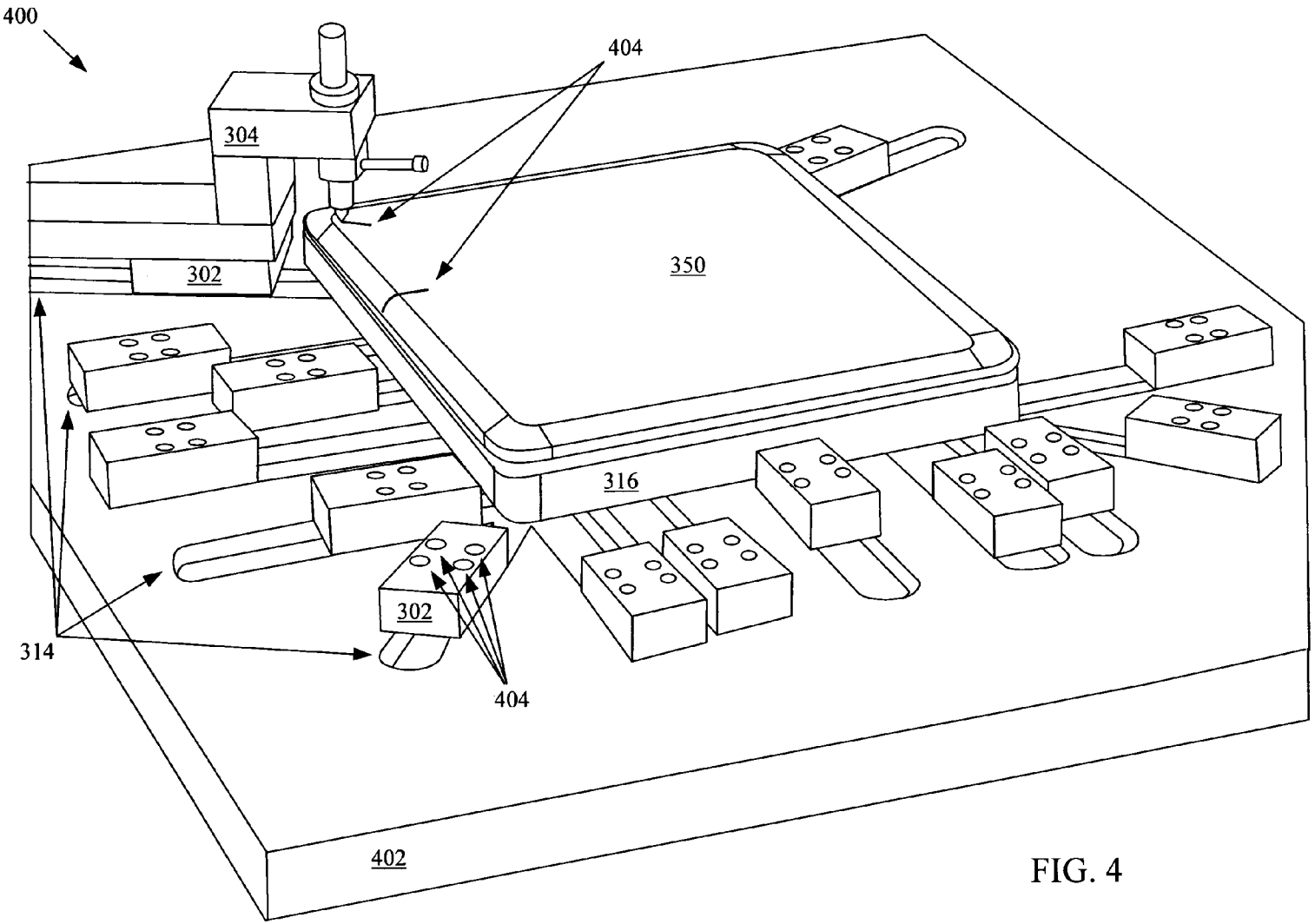
FIG. 4 illustrates a perspective view of a scribing bench suited for use with the mechanical scribing fixture illustrated in FIG. 3 in accordance with the described embodiment.

FIG. 4 illustrates a perspective view of scribing bench 400 upon which the mechanical scribing fixture illustrated in FIG. 3 can be employed. Scribing bench 400 includes base plate 402. In this embodiment scribing bench 400 includes base plate 402 which has a number of channels 314 arranged at an angle normal to an outer periphery of workpiece 350. Workpiece support fixture 316 is mounted in the center of an upper surface of base plate 402. Workpiece support fixture 316 has attachment features for mechanically fixing workpiece 350 securely in place during scribing operations. Channels 314 function as tracks upon which mounting blocks 302 can slide back and forth. Mounting blocks 302 include attachment post receivers 404. By inserting the four attachment posts 306 (not shown) arranged on a bottom surface of scribing fixture support arm 304 into attachment post receivers 404 of any mounting block 302, the weight of mechanical scribing fixture 300 can keep it firmly securely mounted upon that mounting block 302 until the user of scribing bench 400 lifts mechanical scribing fixture 300 and places it on another mounting block 302. In this way mechanical scribing fixture 300 can be used to engrave scribe marks 404 in workpiece 350 anywhere a channel 314 and corresponding mounting block 302 is located.

Figure 5A:
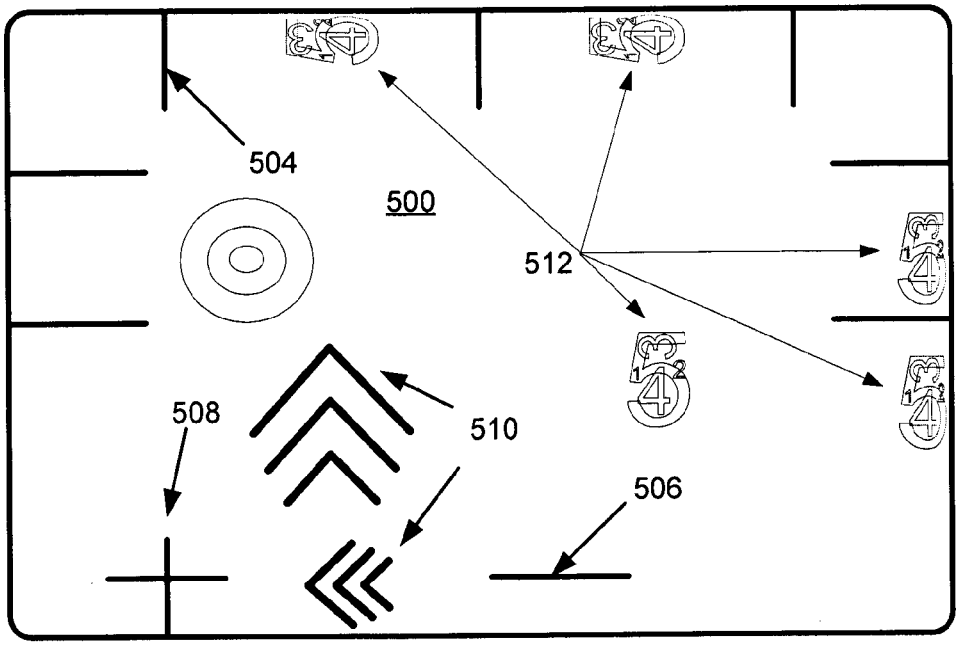
FIG. 5A illustrates a top view of a metal casing inscribed with a number of different types of scribe marks.

FIG. 5A illustrates a variety of ways in which laser scribing can be used to create complex scribe marks. FIG. 5A shows top view of a portable electronics device having a metal case 500. Metal case 500 has curved (spline-shaped) edges and is illustrated having a variety of different types of polishing scribe marks. Polishing scribe marks can be more complex as a laser scriber can be computer controlled and such cuts are not affected by mechanical limitations associated with hard corners and skipping that can occur when traversing a portion of the part that has already been scribed. In this case, the use of metal can result in over polishing in some regions as compared to other regions resulting in a visually unattractive look and feel. Furthermore, by the very nature of metal, handling during an assembly process can result in scratches that in some instances can be reworked. However, in order to assure a more consistent result, a series of polishing scribe marks can be provided described in more detail below. Other types of polishing scribe marks can include scribe mark 506 aligned along a horizontal axis X of metal case 500 and cross type scribe mark 508. In some embodiments cross type scribe mark 508 is useful because the line running along the horizontal X axis can provide a well defined datum part-way down the tapered edge of the metal casing, while the vertical portion of scribe mark 508 provides an accurate indication of how much material a polishing operation has removed all the way across the spline shaped edge of metal case 500. In some cases, chevron type scribe mark 510 can be used to evaluate a polishing process in two dimensions. In some embodiments, several indicia can be etched into the surface of housing 500 where each indicium can indicate a different depth. For example, clustered scribe marks 512 can be formed of a number of different sub-indicia each indicating a different aspect of a polishing operation. In some embodiments clustered scribe marks 512 can be arranged in the center portion of metal case 500. In other embodiments clustered scribe marks 512 can be arranged along the edge of metal case 500 to measure material removal in the spline-shaped edge regions of metal case 500.

Figure 5B:
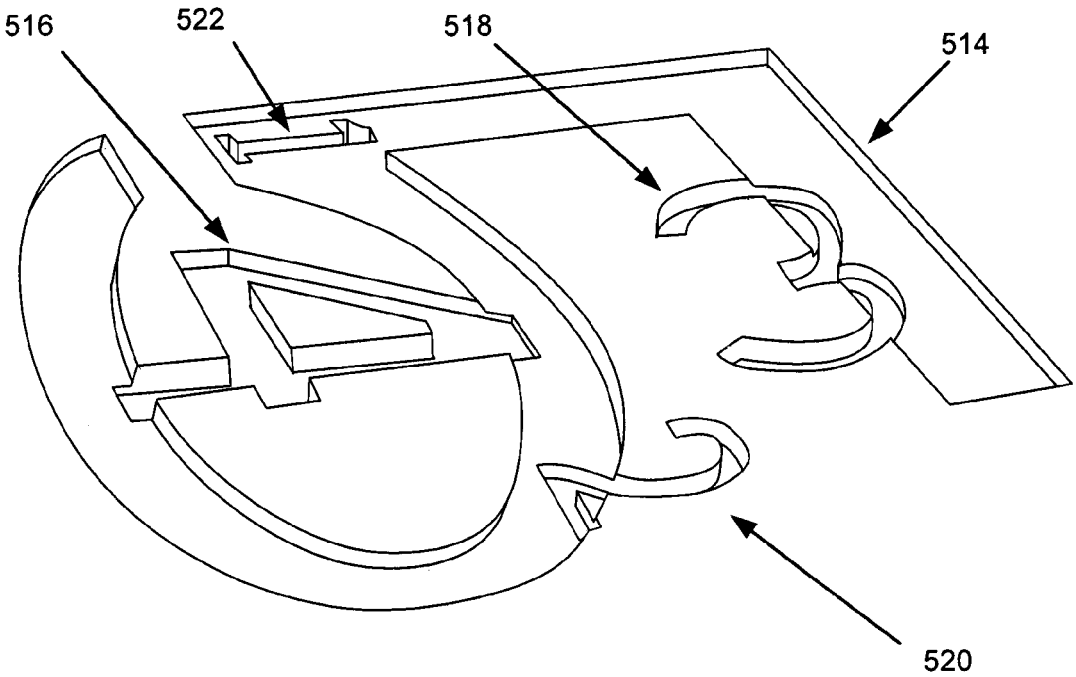
FIG. 5B illustrates a perspective close up view of a set of clustered scribe marks having multiple indicia useful for determining how much material has been removed in a polishing operation.

FIG. 5B shows a perspective view of clustered scribe marks 512. Clustered scribe marks 512 have a number of indicia inscribed into metal casing 500 (in FIG. 5A) at varying depths. First indicia 514 can take the form of a digit "5". In one embodiment first indicia 514 can be inscribed at a depth of 10 microns. Second indicia 516 can be inscribed at a depth of 20 microns. Third indicia 518 can be 30 microns, fourth indicia 520 can be 40 microns and fifth indicia 522 can be 50 microns deep. In this way during a polishing operation an operator or machine can visually determine how much material has been removed to an accuracy of within 10 microns. It should be noted that illustrated indicia 514-522 get gradually smaller as more and more material is removed. In some embodiments fifth indicia 522 can be shaped as a trademark or decorative feature allowing it to remain on metal casing 500 after polishing operations are complete. In this case by measuring the remaining depth of fifth indicia 522 a precise measure of actual material removed can be made with an accuracy equal to about 10 microns. For example, the depth of remaining fifth indicia 522 can be determined optically using any number of well known laser interferometer techniques. This remaining scribe mark can also prevent issues of too much material removal when clustered scribe marks are inscribed with the intention of complete removal, since complete removal of fifth indicia 522 would indicate an over polishing problem. In this way, an easy method for quickly determining a particular polishing depth can be provided throughout the polishing process. It should be noted that first through fifth indicia have been illustrated without center portions in FIG. 5B so that the relative depth of the scribe marks could be more easily observed. The actual indicia more closely resemble the illustration provided in FIG. 5C.

Figure 5C:
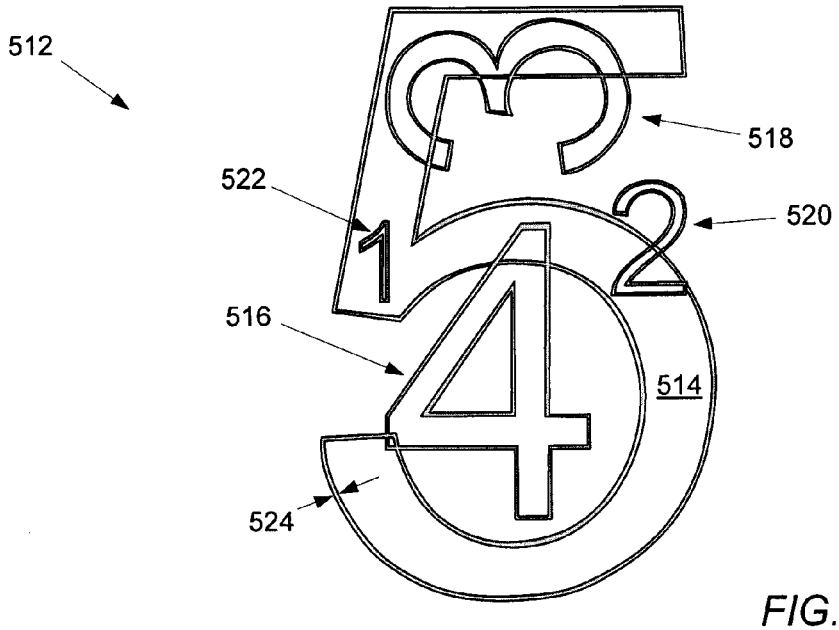
FIG. 5C illustrates a top view of the set of clustered scribe marks illustrated in FIG. 5B.
Figure 5D:
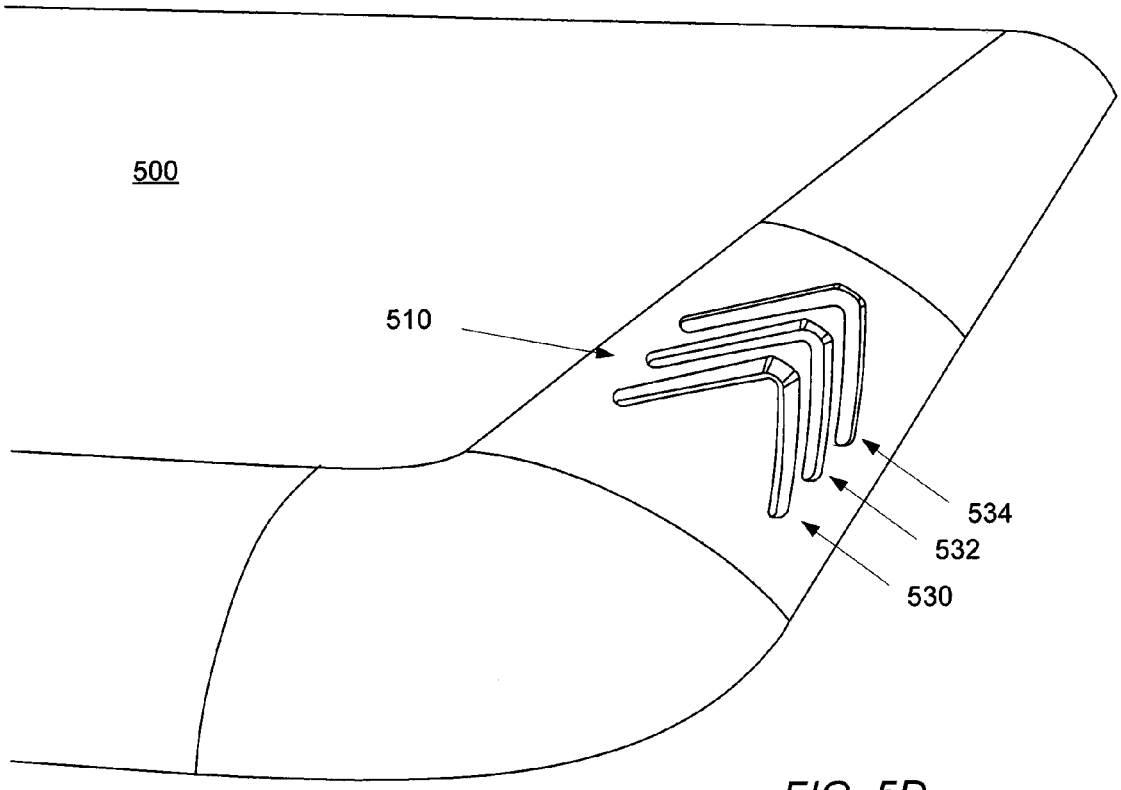
FIG. 5D illustrates a perspective view of a set of clustered scribe marks arranged in a chevron-shaped configuration along a curved edge portion of a metal casing.

FIG. 5C illustrates a top view of clustered scribe marks 512. Here it can be seen that the width of the scribe marks can be quite narrow having a channel width 524 less than the smallest abrasive particle size found on polishing pads to be used during the polishing operation. Channel width 524 in relation to abrasive particle size is important given the explanation accompanying FIGS. 2A-2C. In FIG. 5D a perspective view of a curved edge of metal casing 500 is shown. Chevron type scribe marks 510 are inscribed into the curved edge of metal casing 500. Chevron type scribe marks 510 include first indicia 530, second indicia 532, and third indicia 534. First indicia 530 can be inscribed deeper than second indicia 532, which is inscribed deeper than third indicia 534. In this way as a polishing operation progresses chevron type scribe marks 510 are sanded away one at a time, visually indicating the amount of material removal that has taken place. Chevron type scribe marks 510 can be formed by single scribe marks as illustrated or by scribe marks outlining a larger chevron shape, similar to the numbers illustrated in FIG. 5C. Since chevron type scribe marks 510 extend across a majority of the curved edge of metal casing 500 they are able to give a good indication of material removal depth across a majority of the curved edge. As this particular edge geometry is often difficult to predict polishing removal rates for such a set of scribe marks is highly desirable.

In some embodiments an electronic device housing can be made from a thermoplastic compound. Thermoplastic compounds can provide a lightweight moldable material that exhibits desirable properties, such as strength, heat resistance and structural flexibility well suited for casings of portable electronic devices. A representative thermoplastic compound can include PC/ABS (polycarbonate acrylonitrile butadiene styrene) polymer, although other thermoplastic compounds can be used. Both the tactile and visual appearance of a portable electronics device can enhance the desirability of the device to the consumer. A cosmetic outer layer formed from a thermoplastic blend can be polished to a desired reflective appearance while retaining an aesthetically pleasing shape. In some embodiments, a continuously smooth shape having a uniformly visually smooth appearance can be desired. In other embodiments outer layers can be formed from metallic parts can also include scratches due to handling that may require rework. Regardless of the material used the cosmetic outer layer must include a cosmetically smooth exterior surface.

Figure 6A:
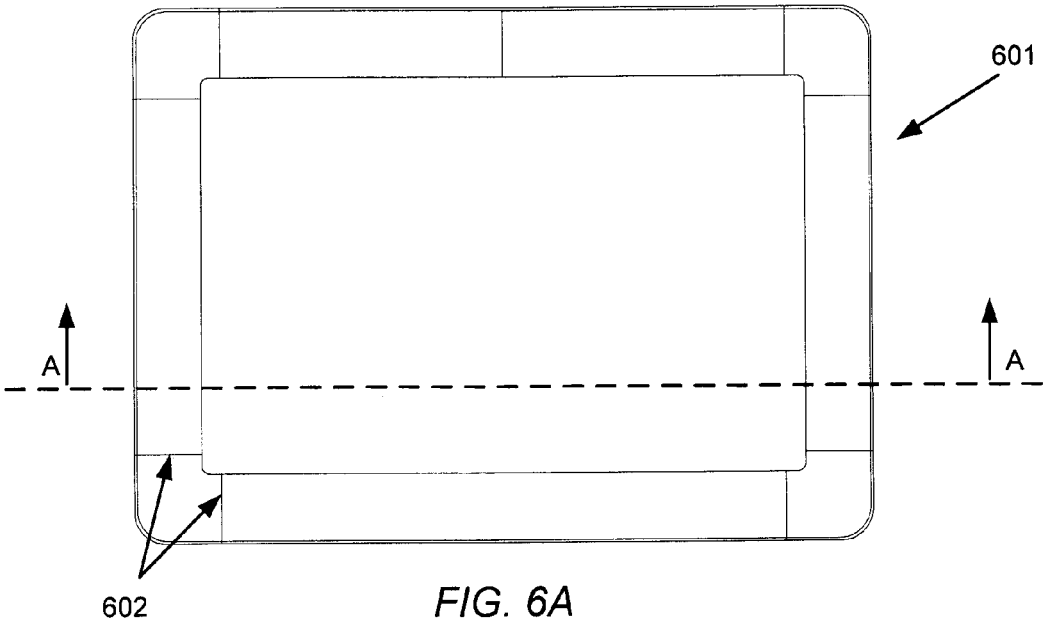
FIG. 6A illustrates a top view of a thermoplastic casing of a portable computing device having parting lines due to an injection molding process.
Figure 6B:
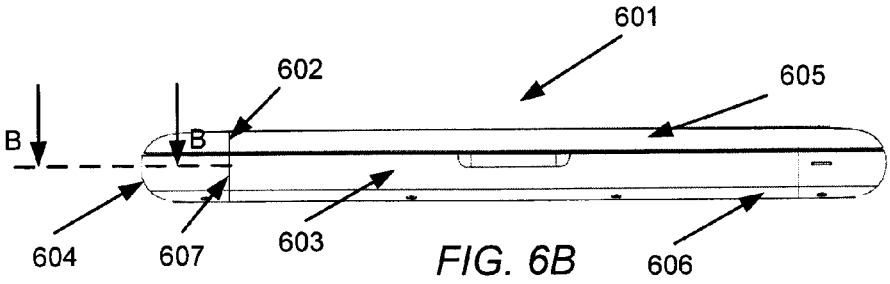
FIG. 6B illustrates a front view of the thermoplastic casing illustrated in FIG. 6A.

FIG. 6A illustrates a top view of a portable electronics device 601 including markings of several possible parting lines 602 on a molded thermoplastic top casing of the portable electronics device 601. FIG. 6B illustrates a front view of the portable electronics device 601 of FIG. 6A including a molded thermoplastic top casing 605, a molded thermoplastic center casing 603 and a base 606. The top casing 605 and the center casing 603 can be formed separately in two different injection molds, each with differently located parting lines in general, even though a parting line 607 of the center casing 603 aligns with the parting line 602 of the top casing 605 as illustrated in FIG. 6B. Each of the parting lines of the center casing 603 can be removed by appropriate polishing. The three-dimensional edge 604 of the center casing can have a specific complex geometric shape that provides an aesthetically pleasing appearance for the portable electronics device 601.

Figure 7:
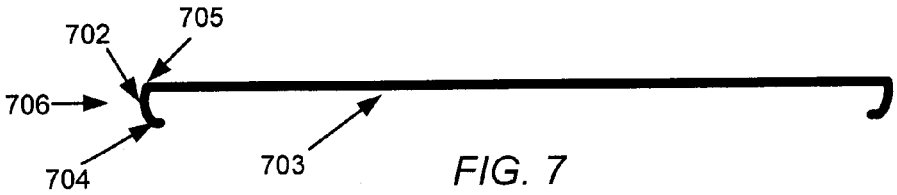
FIG. 7 illustrates a cross-section of the thermoplastic casing illustrated in FIG. 6A

FIG. 7 illustrates a cross section 703 of the center casing 603 (along the dashed line and viewed in the direction A in FIG. 1A) including a complex shaped edge 706 (cross section of edge 604 of FIG. 6B). The complex shaped edge 706 can include three distinct regions, a corner region 705 where the side meets the top, an upper region 702 of the side and a lower region 704 of the side. The three different regions 702, 704 and 705 can be finished using one or more different polishing methods. In particular, the corner region 705 can be finished to produce an unsharpened rounded edge using a conventional technique. Such techniques are well known to those skilled in the art. The upper region 702 and the lower region 704 of the complex shaped edge can be finished to achieve a tactilely and visually uniformly smooth reflective surface using at least one of the polishing methods described in the previous figures.

Figure 8A:
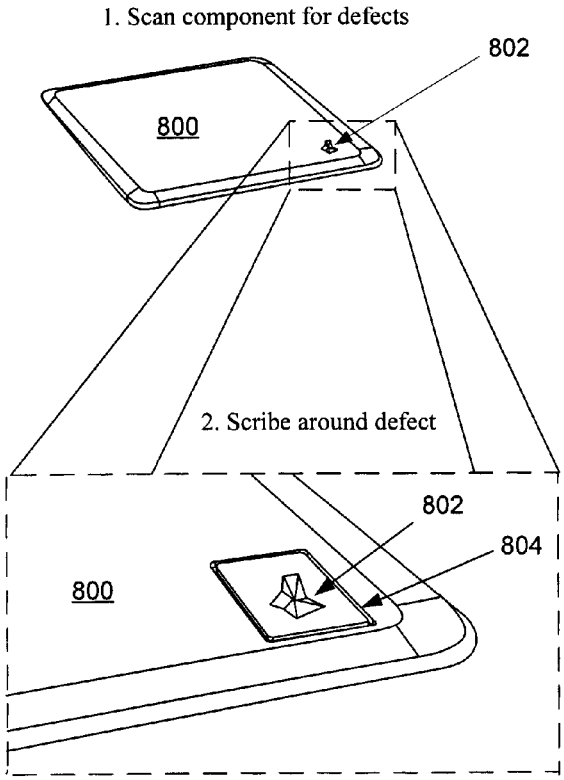
FIG. 8A illustrates a perspective view of a metal casing with a defect that may be able to be reworked into a usable part by a polishing operation.
Figure 8B:
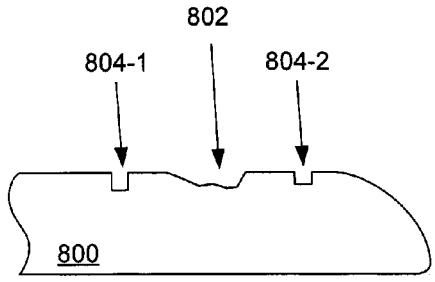
FIG. 8B illustrates a close up view and cross-sectional view of the defect illustrated in FIG. 8A with a rework scribe mark surrounding the defect.
Figure 8C:
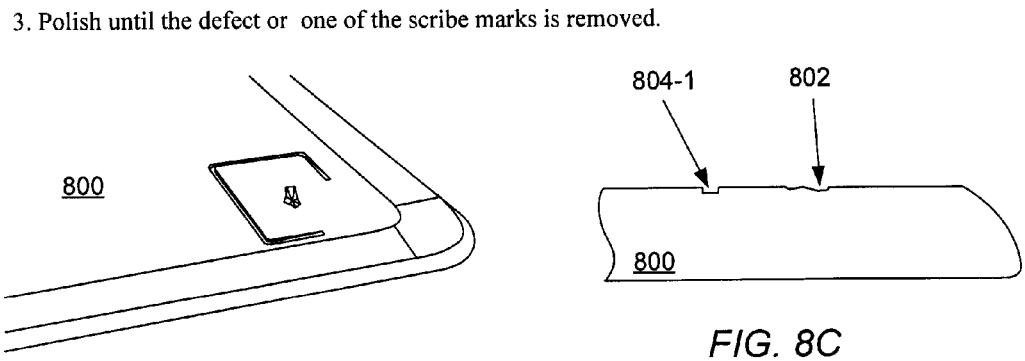
FIG. 8C illustrates a close up view and cross-sectional view of a partially removed defect and a the rework scribe mark a portion of which has been completely polished away.

FIG. 8A shows a perspective view of electronic device housing 800 showing defect 802 that is a candidate for rework. In order to determine if scratch 802 is suitable for rework, housing 800 is scanned or otherwise evaluated for the presence of defect 802. For example, housing 800 can be optically scanned (either manually or automatically) to determine the presence of defect 802. Optical scanning can be accomplished by any number of imaging sensors analyzing electronic device housing across any number of light wavelengths. Once defect 802 is determined to be present, then rework scribe marks 804 can be formed as illustrated in FIG. 8B. Rework scribe marks 804 can include a number of discrete scribe marks each having different scribe depths in accordance with a maximum material removal depth for that portion of electronic device housing 800 so that it can be reworked without adversely affecting the look and feel of housing 800. In some cases the discrete scribe marks can have circular openings extending straight down into electronic device housing 800. In another embodiment, as illustrated a continuous scribe mark can encircle the detected defect. Also as illustrated the defect depth can be variable based on the location of the scribe. This can be useful when certain portions of the housing have lower tolerance for material removal, as the scribe mark can precisely illustrate the tolerances at every point around the detected defect. In this example, defect 802 can have a depth that is very close to the maximum permissible removal depth. In such a case while the defect may be of a permissible removal depth the polishing could affect proximate areas of housing 800 that are not able to absorb as much material removal. In that case this scribing operation can prevent a part from being over-polished and then unwittingly returned to the manufacturing line with a shape somewhat out of tolerances. Another potential use for this method is again where the defect depth is very close to tolerances and the optical scanner does not have enough resolution to determine whether the defect actually exceeds tolerances. In that case, as shown in FIG. 8C when a portion of the scribe mark has been completely removed and the defect is still present it becomes easy to cease rework knowing that the defect has put housing 800 outside of permissible tolerances. However, if defect 802 is completely removed while scribe mark 804-1 and 804-2 are still visible, then reworkers can reintroduce electronic device housing 800 back into the manufacturing line with confidence that it is clearly within tolerances.

Figure 9:
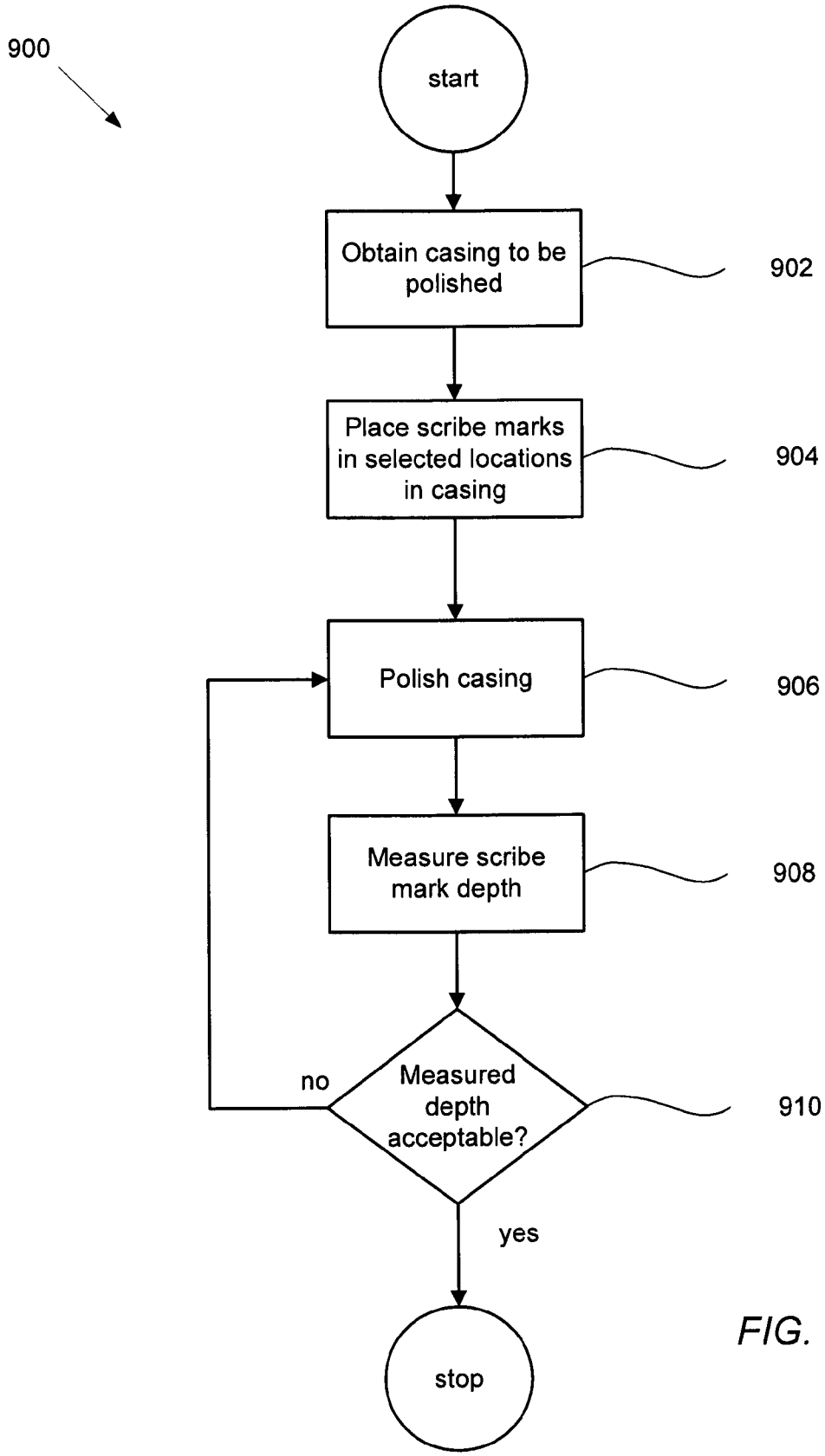
FIG. 9 shows a flow chart detailing a process for using scribe marks to accurately determine material removal amounts.

FIG. 9 shows a flowchart detailing a process 900 for using scribe marks during a polishing operation in accordance with the described embodiments. Process 900 can be performed by obtaining a casing to be polished at 902. The casing can be formed of metal such as aluminum or stainless steel or the casing can be non-metallic formed of molded material such as thermoplastic. Next at 904, several scribe marks are formed in at least a single location in the casing, although in some embodiments a number of scribe marks can be spread across a number of surfaces of the casing. The scribe marks can be created with a mechanical scribing device or by laser ablation. In some manufacturing lines scribe marks can be placed in the casing much earlier than just prior to the polishing step. In some cases, the scribe marks can have varying depths and varying orientations with respect to major and/or minor axes of the casing. The scribe marks can also have a variety of shapes (cross, chevron, single line, multiple lines, etc.). In some embodiments scribe marks can be placed in accordance with an idealized shape of the casing. In this way if there is a certain amount of sample variation present in the casing the scribe marks still precisely show the maximum permissible depth with respect to an ideal shape, instead of being too shallow or too deep as a result of potential sample variations. This type of scribing is more easily implemented with a scribing method capable of achieving precise scribe depths. One such feasible scribing method is achieved using a pulsed laser to carry out a laser ablation process. A laser can be used that etches away a known amount of material. The material is etched away by localized heating which causes the solid metal to sublimate off the surface of the casing. By making multiple passes with that laser the depth of the scribe mark can be precisely modulated to obtain scribe marks having different depths with a single laser.

At 906, a polishing operation is performed. The duration of the polishing operation can depend upon the variability of the polishing operation. Where a polishing operation is well known and predictable a majority of the polishing can take place before a check of the scribe marks is made. Alternatively, where polishing operations are subject to more variability polishing operations may only take place for a short period. At 908 the scribe marks are checked. In many cases machining debris may need to be removed from the scribe marks before the scribe marks can be properly checked. In some embodiments where the scribe mark is not human readable, scribe marks are measured to determine the amount of material that has been removed during the polishing operation. At 910 a determination is made of whether enough material has been removed during the polishing operation. In some cases such as when polishing a curved surface uneven polishing can occur. In that case when more polishing is required the polishing pads can be recalibrated to concentrate polishing operations in areas that may have had less material removed. Polishing and checking then continues until the measured depth across all the scribe marks is acceptable at which point polishing operations are terminated for that casing.

Figure 10:
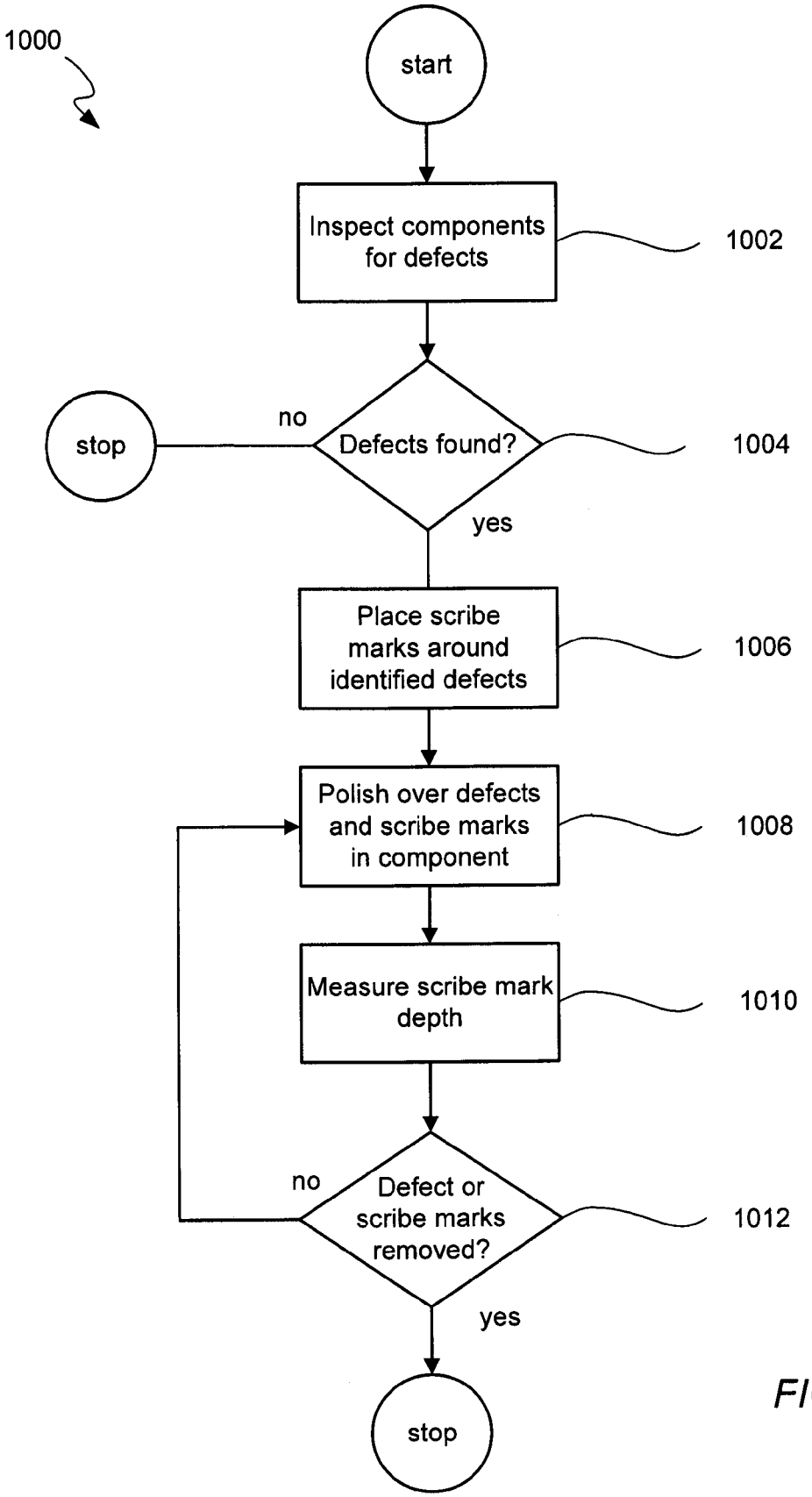
FIG. 10 shows a flow chart detailing a process for reworking a damaged component with a polishing operation in accordance with the described embodiment.

FIG. 10 shows a flowchart detailing a process 1000 for using scribe marks during a rework polishing operation in accordance with the described embodiments. As part of quality assurance programs components are frequently scanned for defects. This is especially common when the components have cosmetic surfaces susceptible to scratching or gouging; therefore, in step 1002 a component part having cosmetic surfaces is scanned for defects. The scanning portion of the operation can be accomplished with a simple human inspection or with a more complex automated scanning solution that can include a computer controlled vision system with the capacity to detect the smallest of defects or surface variations. In step 1004 if the inspection turns up a defect then that component is passed on for rework, and if not it can continue on in a manufacturing process to be assembled as part of a complete product. At step 1006 scribe marks are placed in the component around any identified defect or defects. The scribe marks can be created with a mechanical fixture device inscribed or by laser ablation. In some cases, the scribe marks can have varying depths and varying orientations with respect to the defect. The scribe marks can also have a variety of shapes (cross, chevron, single line, multiple lines, etc.). In some embodiments a series of holes at depths equal to the maximum material removal depth can be utilized. In other embodiments a continuous line can encircle the defect, dictating precise depths all around the defect at which no more material can be removed. At step 1008 a polishing operation is conducted. The polishing pad should be configured to match the existing exterior cosmetic surface of the part. After the polishing pad has been in operation long enough to remove a certain percentage of the authorized material, then in step 1010, the scribe depth can be evaluated. In some cases the evaluation will consist of measuring the depth of each scribe mark. In situations involving a lower degree of precision an operator might only need to check to make sure that none of the scribe marks have been completely removed. In step 1012 if either the defect or any of the scribe marks have been completely removed then the process is terminated. Where the scribe marks have been removed before the defect, then the part is considered "no good" and will not undergo any further processing. Where the defect is removed before the scribe marks a subsequent processing step can include removing or masking the presence of the rework scribe marks; however if neither the defect nor the scribe marks are removed the process returns to step 1008.

Figure 11:
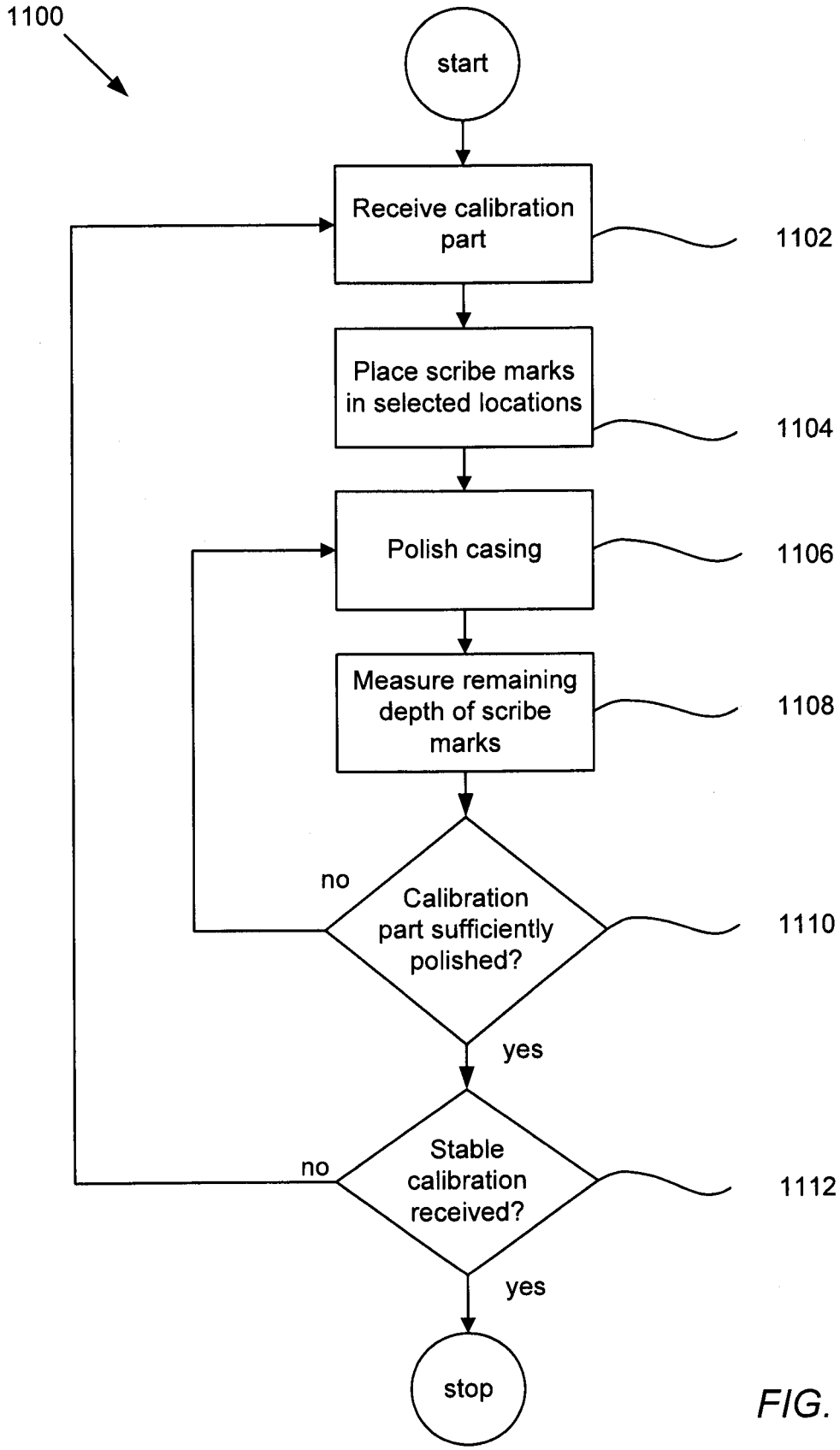
FIG. 11 shows a flow chart detailing a process for destructively testing a workpiece for establishing a repeatable polishing process for a manufacturing process.

FIG. 11 shows a flowchart detailing a process 1100 for calibrating a polishing process. By establishing a baseline calibration for a polishing operation an unpredictable process can become predictable, thereby greatly speeding a manufacturing line including a polishing operation. This is especially relevant in situations where curved surfaces are polished, since curved surfaces can result in variable pressures being applied across the surface of a polishing pad, thereby causing accelerated, uneven pad wear along with difficulty in determining material removal rate across the entire contour of the curved surfaces. In initial step 1102 a calibration part is received. The calibration part will never see a production line as it is effectively destroyed as part of the testing process. In step 1104 scribe marks are placed in selected locations on the part. These scribe marks will be placed with greater frequency in locations on the part where material removal rates are more subject to unpredictability. Because the part will never see a regular production line deep scribe marks can be inscribed at depths reaching past the level normally permissible for material removal. It should be noted that the scribe marks still need to have a width less than the minimum abrasive particle size as explained in FIGS. 2A-2C. In step 1106 a polishing operation is performed. At the beginning of a calibration process the polishing operation will be relatively short so that material removal rates can be closely scrutinized. Likewise, as the calibration gets closer and closer to being finished this polishing operation can be longer and longer as the risk of over-polishing decreases due to increased certainty of material removal rates. At step 1108 scribe mark depths are measured. At step 1110 if the part is fully polished the process continues to step 1112, otherwise the scribe mark depth measurements can be fed back into the polishing control algorithms for fine tuning before the process returns to step 1106. At step 1112 a determination is made whether or not a sufficiently predictable calibration has been achieved. Where the polishing process has remained sufficiently stable across a number of calibration part runs the stable calibration determination will likely be achieved. Once this baseline is achieved the process can be implemented on a production line. On the production line an occasional calibration run may need to be periodically run to ensure the polishing process is still within tolerances. Testing results can then be used to fine tune the production machinery. Depending on the tolerances involved this type of retesting can be required more or less frequently.

Figure 12:
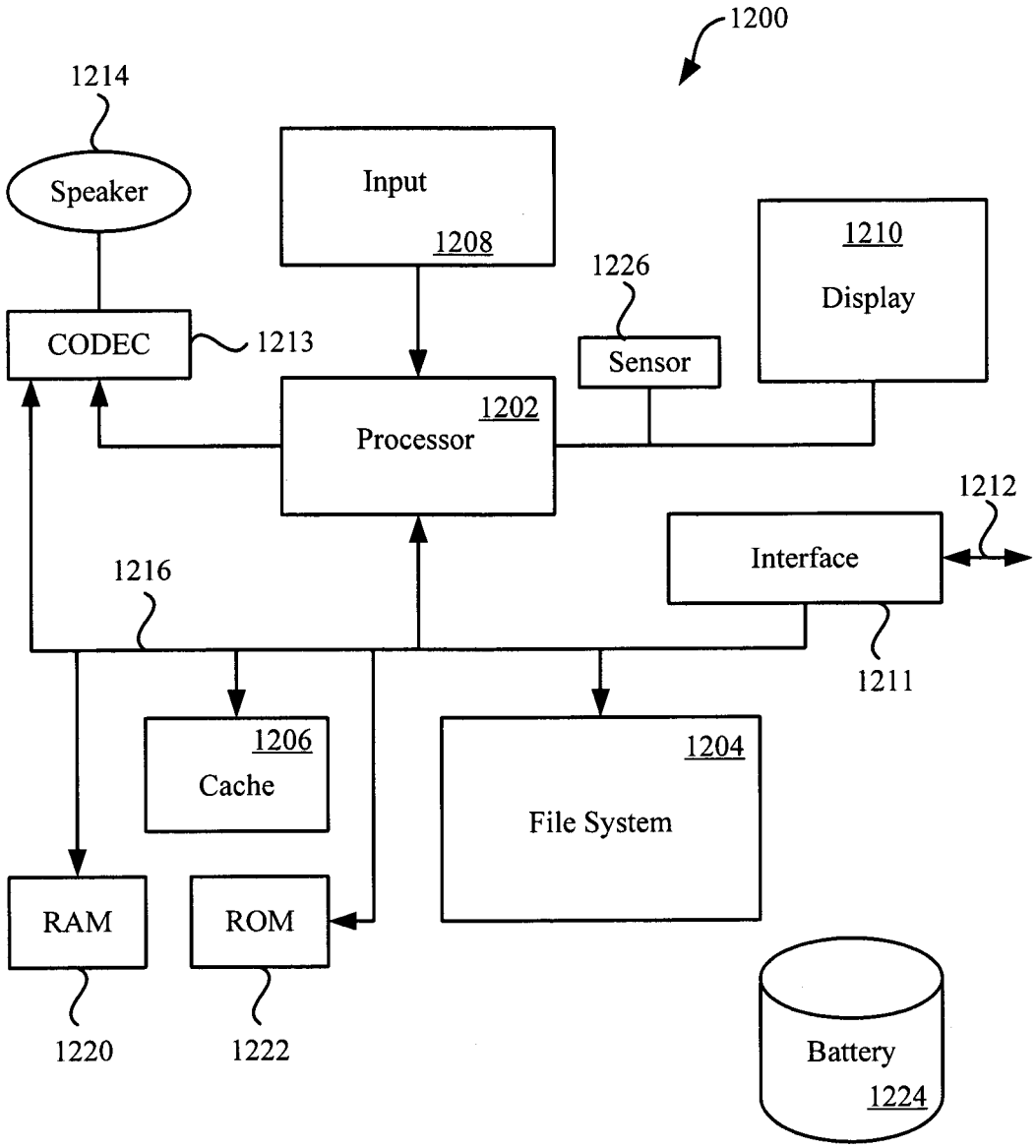
FIG. 12 shows a block diagram for an electronic device useful in controlling a manufacturing operation in accordance with the describe embodiments.

FIG. 12 is a block diagram of electronic device 1200 suitable for controlling a scribing process in accordance with the described embodiment. Electronic device 1200 illustrates circuitry of a representative computing device. Electronic device 1200 includes a processor 1202 that pertains to a microprocessor or controller for controlling the overall operation of electronic device 1200. Electronic device 1200 contains instruction data pertaining to manufacturing instructions in a file system 1204 and a cache 1206. The file system 1204 is, typically, a storage disk or a plurality of disks. The file system 1204 typically provides high capacity storage capability for the electronic device 1200. However, since the access time to the file system 1204 is relatively slow, the electronic device 1200 can also include a cache 1206. The cache 1206 is, for example, Random-Access Memory (RAM) provided by semiconductor memory. The relative access time to the cache 1206 is substantially shorter than for the file system 1204. However, the cache 1206 does not have the large storage capacity of the file system 1204. Further, the file system 1204, when active, consumes more power than does the cache 1206. The power consumption is often a concern when the electronic device 1200 is a portable device that is powered by a battery 1224. The electronic device 1200 can also include a RAM 1220 and a Read-Only Memory (ROM) 1222. The ROM 1222 can store programs, utilities or processes to be executed in a non-volatile manner. The RAM 1220 provides volatile data storage, such as for cache 1206.

The electronic device 1200 also includes a user input device 1208 that allows a user of the electronic device 1200 to interact with the electronic device 1200. For example, the user input device 1208 can take a variety of forms, such as a button, keypad, dial, touch screen, audio input interface, visual/image capture input interface, input in the form of sensor data, etc. Still further, the electronic device 1200 includes a display 1210 (screen display) that can be controlled by the processor 1202 to display information to the user. A data bus 1216 can facilitate data transfer between at least the file system 1204, the cache 1206, the processor 1202, and a CODEC 1213. The CODEC 1213 can be used to decode and play a plurality of media items from file system 1204 that can correspond to certain activities taking place during a particular manufacturing process. The processor 1202, upon a certain manufacturing event occurring, supplies the media data (e.g., audio file) for the particular media item to a coder/decoder (CODEC) 1213. The CODEC 1213 then produces analog output signals for a speaker 1214. The speaker 1214 can be a speaker internal to the electronic device 1200 or external to the electronic device 1200. For example, headphones or earphones that connect to the electronic device 1200 would be considered an external speaker.

The electronic device 1200 also includes a network/bus interface 1211 that couples to a data link 1212. The data link 1212 allows the electronic device 1200 to couple to a host computer or to accessory devices. The data link 1212 can be provided over a wired connection or a wireless connection. In the case of a wireless connection, the network/bus interface 1211 can include a wireless transceiver. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or visual content. Sensor 1226 can take the form of circuitry for detecting any number of stimuli. For example, sensor 1226 can include any number of sensors for monitoring a manufacturing operation such as for example a Hall Effect sensor responsive to external magnetic field, an audio sensor, a light sensor such as a photometer, a depth measurement device such as a laser interferometer and so on.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line used to fabricate computer components such as computer housing formed of metal or plastic. The computer readable medium is any data storage device that can store data which can thereafter be read by a computer system. Examples of the computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. a method for refining polishing accuracy across a curved surface of a housing, comprising:

polishing at least a portion of the curved surface of the housing that includes a plurality of clustered scribe marks etched across at least a portion of the curved surface of the housing, the plurality of clustered scribe marks comprising:

a first plurality of indicia at a first location, each indicia having a different predetermined depth dimension, a deepest one of the indicia having a depth no greater than a maximum material removal depth, and a second plurality of indicia at a second location different than the first location;

optically checking a material removal amount around the portion of the curved surface of the housing that includes the plurality of clustered scribe marks by observing how many of the indicia remain visible; and adjusting the polishing to cause an amount of material removed during the polishing at the first and second locations to be about the same.

2. The method of claim 1, wherein each of the indicia have a width dimension no greater than a minimum abrasive particle diameter of a polishing device used to conduct the polishing of the surface of the housing.

3. The method of claim 2 further comprising:

continuing to polish and optically check the curved surface of the housing until the last of the plurality of indicia of the clustered scribe marks is removed from the curved surface of the housing.

4. The method of claim 1, wherein the housing is formed of metal.

5. The method of claim 1, wherein the plurality of clustered scribe marks are arranged in a chevron configuration.

6. The method of claim 2, wherein the plurality of clustered scribe marks are rework scribe marks, wherein the maximum material removal depth corresponds to a maximum scratch depth allowed for a scratch rework process.

7. The method of claim 6, wherein the plurality of clustered scribe marks are circular holes extending vertically into the surface of the housing.

8. The method of claim 1, wherein the plurality of scribe marks are mechanically etched into the curved surface.

9. The method of claim 1, wherein the plurality of scribe marks are etched into the curved surface by laser ablating the housing.

10. An apparatus, comprising:

a laser having a wavelength small enough to etch scribe marks narrower than a minimum abrasive particle diameter of a polishing pad used to polish the housing; and a computer numerical control (CNC) system for orienting the laser along a desired scribe mark path as it cuts scribe marks across a curved surface of the housing, wherein the laser is configured to scribe a plurality of clustered scribe marks into the curved surface of the housing, the clustered scribe marks comprising:

a first plurality of indicia at a first location, each indicia having a different depth dimension, the deepest of the indicia having a depth no greater than a maximum material removal depth, and a second plurality of indicia at a second location different than the first location, wherein a polishing operation is adjusted to cause a material removal amount to be about the same at both the first location and the second location.

11. The apparatus as recited in claim 10, further comprising a vision system that optically determines which ones of the plurality of indicia remain visible.

12. The apparatus as recited in claim 10, wherein the optically readable scribe marks have a depth of between 10 and 50 microns.

13. The apparatus as recited in claim 10, wherein at least one of the plurality of indicia acts as a datum for measuring material removal across the curved surface of the housing.

14. A non-transient computer readable medium for storing computer code executable by a processor in a computer aided manufacturing system for polishing a surface of a housing, comprising:

computer code for obtaining the housing, the housing including a plurality of clustered scribe marks disposed across the surface of the housing, the clustered scribe marks comprising:

a first plurality of indicia at a first location, each indicia having a different depth dimension, and a second plurality of indicia at a second location different than the first location wherein a relative position of each of the indicia in relation to other indicia makes it optically discernible from the other indicia;

computer code for polishing the surface of the housing including the plurality of clustered scribe marks;

computer code for optically checking a material removal amount proximate the plurality of clustered scribe marks by observing which ones of the plurality of indicia remain visible computer code for adjusting the polishing to cause an amount of material removed during the polishing at the first and second locations to be about the same.

15. The non-transient computer readable medium as recited in claim 14, wherein the plurality of clustered scribe marks are provided at an early stage in a manufacturing process, thereby allowing the plurality of indicia to indicate material removal amounts during various stages of the manufacturing process.

16. The non-transient computer readable medium as recited in claim 14, wherein the plurality of indicia comprises a first plurality of indicia and wherein at least a portion of the first plurality of indicia are disposed across a curved surface of the housing.

17. The non-transient computer readable medium as recited in claim 16, wherein the plurality of clustered scribe marks further comprises a second plurality of indicia, at least a portion of the second plurality of indicia being disposed across the curved surface and wherein a curvature of the curved surface is maintained by adjusting the polishing operation to keep the first plurality of indicia consistent with the second plurality of indicia.

18. The non-transient computer readable medium as recited in claim 14, wherein the plurality of clustered scribe marks are mechanically scribed across the surface of the housing.

19. The non-transient computer readable medium as recited in claim 17, wherein the first and second plurality of indicia each include at least three indicia of different depths, each of the indicia being visible along the surface of the housing after being provided.

* * * * *

UNITED STATES PATENT AND TRADEMARK OFFICE

CERTIFICATE OF CORRECTION

PATENT NO. : 8,798,782 B2
APPLICATION NO. : 13/531562
DATED : August 5, 2014
INVENTOR(S) : Simon R. Lancaster-Larocque et al.

It is certified that error appears in the above-identified patent and that said Letters Patent is hereby corrected as shown below:

In the Specification:

Column 5, line 53: “course” should read --coarse--.

Column 8, line 20: “electronics” should read --electronic--.

In the Claims:

Column 14, line 63 (Claim 1, line 1): “a method” should read --A method--.

Signed and Sealed this
Fourteenth Day of October, 2014

Michelle K. Lee

Michelle K. Lee
*Deputy Director of the United States Patent and Trademark Office*